US006026831A

United States Patent [19]

Jarvis

[11] Patent Number: 6,026,831

[45] Date of Patent: Feb. 22, 2000

[54] SINGLE-UNIT, CONVEYOR-TYPE WASHER

[75] Inventor: Michael F. Jarvis, Huntingdon Valley, Pa.

[73] Assignee: Insinger Machine Company, Philadelphia, Pa.

[21] Appl. No.: 09/195,516

[22] Filed: Nov. 19, 1998

[51] Int. Cl.[7] ..... B08B 3/02

[52] U.S. Cl. ..... 134/72; 134/127; 134/131

[58] Field of Search ..... 134/68, 71, 72, 134/73, 74, 127, 131

[56] References Cited

U.S. PATENT DOCUMENTS

| | | | |
|---|---|---|---|
| 2,698,627 | 1/1955 | Kearney et al. | 134/72 X |
| 4,281,675 | 8/1981 | Pure | 134/125 |
| 4,344,448 | 8/1982 | Potts | 134/73 |
| 5,497,798 | 3/1996 | Fritz et al. | 134/151 |

OTHER PUBLICATIONS

Product Info sheet for Insinger Admiral 66–3 Conveyor Dishwasher, 2 pp., Sep. 1996.

Product Info sheet for Insinger TRAC 321–2 RPW Tray Washer, 2 pp., Aug. 1996.

Product info sheet for Insinger TD 321–3 Tray Dryer, 2 pp., Aug. 1996.

Product Info sheet for Stero STW Series Tray Washer, 2 pp., date unknown.

Web cite Product Info printout of Stero STW Tray Washer, 3 pp., date unknown.

Web cite Product Info printout of Stero SCBT Combination Dishwasher and Tray Washer, 4 pp., date unknown.

*Primary Examiner*—Philip R. Coe

*Attorney, Agent, or Firm*—Howson and Howson

[57] ABSTRACT

A washer capable of simultaneously washing trays and dishware. The single unit washer has a dual conveyor system. One conveyor transports trays through the washer and another conveyor transports racks containing dishware and drinking vessels. Preferably, the single unit also includes a dryer which efficiently utilizes the same supply of air to dry both the trays and the dishware. The conveyor system is specifically configured to prevent fast racking and to provide ease in loading/unloading.

20 Claims, 4 Drawing Sheets

SINGLE-UNIT, CONVEYOR-TYPE WASHER

FIELD OF THE INVENTION

The present invention relates to a washer for cleaning large quantities of trays and various other dishware, and more particularly, the present invention relates to a commercial washer having a pair of conveyors enabling the simultaneous cleaning of both the trays and the assorted dishware articles.

BACKGROUND OF THE INVENTION

U.S. Pat. No. 4,281,675, which issued to Pure and which is assigned to the assignee of the present application, discloses a commercial washer for washing insulated trays transported through the washer on an endless conveyor. The trays are disposed in an upright position as they pass through and are cleaned in the washer. The washer is particularly suited for use by institutional organizations such as prisons and the like which are required to clean a large quantity of trays an a daily basis. The cleaned trays are permitted to air dry after they exit the washer. Alternatively, a separate dryer can be arranged downstream from the washer to receive and dry the cleaned trays after they exit the washer.

Institutions which utilize the above-mentioned washer for cleaning insulated trays also require cleaning of other articles of dishware which are not intended to be washed in an insulated tray washer. For instance, eating utensils, such as spoons and the like, and drinking vessels, such as tumblers and glasses, may also require cleaning in addition to the insulated trays. An example of such a conveyor dishwasher is disclosed in U.S. Pat. No. 5,497,798 which issued to Fritz et al. and which is also assigned to the assignee of the present application. Therefore, an institution, such as a state or federal prison facility, would conventionally require use of separate washers and/or separate dryers for cleaning various articles of dishware and trays.

Typically, the elongate rear sides of commercial washers and/or dryers are positioned against walls regardless of whether or not they were designed to be positioned in that manner. In addition, institutions which utilize the washers for trays and the like typically have only a minimum of floor space to locate the various washers and/or dryers. Thus, the positioning of the washers adjacent to walls, the close spacing of the various equipment, and the limited amount of floor space tend to restrict the ease in which the trays and dishware can be loaded and unloaded by the user.

Although various ones of the aforementioned washers function in a superior manner for their intended purposes, there is a need for a washer which is capable of simultaneously cleaning trays and dishware in a single unit. The washer should take up a minimum of floor space and should permit ready and convenient loading and unloading of trays and dishware even when the rear side of the washer is located against a wall and when the washer is located in a tight space. Preferably, the washer should also be capable of drying the trays and dishware in an efficient manner within the single unit.

OBJECTS OF THE INVENTION

With the foregoing in mind, a primary object of the present invention is to provide a washer capable of simultaneously cleaning trays and dishware in a single unit.

Another object of the present invention is to provide a commercial washer which can be loaded and unloaded in a ready manner despite the washer being abutted against a wall or being located in a tight working space.

A further object of the present invention is to provide a washer combined with a dryer in a single unit which functions in an energy efficient manner.

A still further object of the present invention is to provide a washer having a conveyor system which prevents so called "fast-racking" which is defined as the unwanted ability of the trays or dishware to be manually pushed on the conveyor through the washer at a greater speed then the intended pre-determined speed of the conveyor system.

SUMMARY OF THE INVENTION

More specifically, the present invention provides a single-unit conveyor-type washer for simultaneously washing trays and other dishware related articles such as drinking vessels and eating utensils. The washer has a cleaning chamber with at least a washing section and a rinsing section confined within an elongate front side, an elongate rear side, and opposite ends. One of the opposite ends of the chamber provides a chamber entrance and the other opposite end provides a chamber exit.

The washer includes a pair of spaced-apart, parallel-extending conveyors which extend through the washing and rinsing sections. One of the conveyors conveys vertically disposed trays along a path of travel from the chamber entrance to the chamber exit, and the other conveyor conveys racks along a path of travel from the chamber entrance to the chamber exit. The racks are capable of being loaded with various dishware related articles.

The chamber entrance is accessible adjacent the chamber elongate front side so that the trays and the racks can be readily loaded on their respective conveyors. To provide further ease in loading for the user, the conveyor for the trays is located closer to the chamber elongate front side than to the chamber elongate rear side, and the rack conveyor is located closer to the chamber elongate rear side than to the chamber elongate front side.

According to another aspect of the present invention, each of the conveyors respectively conveys the trays, or racks, along its path of travel through the cleaning chamber at a pre-determined set linear speed. Each conveyor includes fast-racking-prevention means for preventing the trays, or racks, from being manually pushed on the conveyor along its path of travel at a speed greater than the set pre-determined linear speed. Preferably, this is accomplished by constructing either or both of the conveyors with an endless chain having a plurality of fast-racking-prevention lugs.

According to yet another aspect of the present invention, the cleaning apparatus is provided by a combination washer and dryer in a single-unit. To this end, the chamber includes a drying section which is located adjacent the chamber exit and which has at least a pair of nozzles positioned on opposite sides of the path of travel of the conveyor for the trays. The nozzles discharge a flow of air at a transverse direction onto each side face of the vertically disposed trays to remove moisture from the trays. In addition, the dryer section is configured to cause the flow of air discharged by the nozzles to reflect off the trays and to flow turbulently within the dryer section along the path of travel of the conveyor of the racks to promote evaporation of moisture located on the dishware related articles stacked in the racks.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 1:
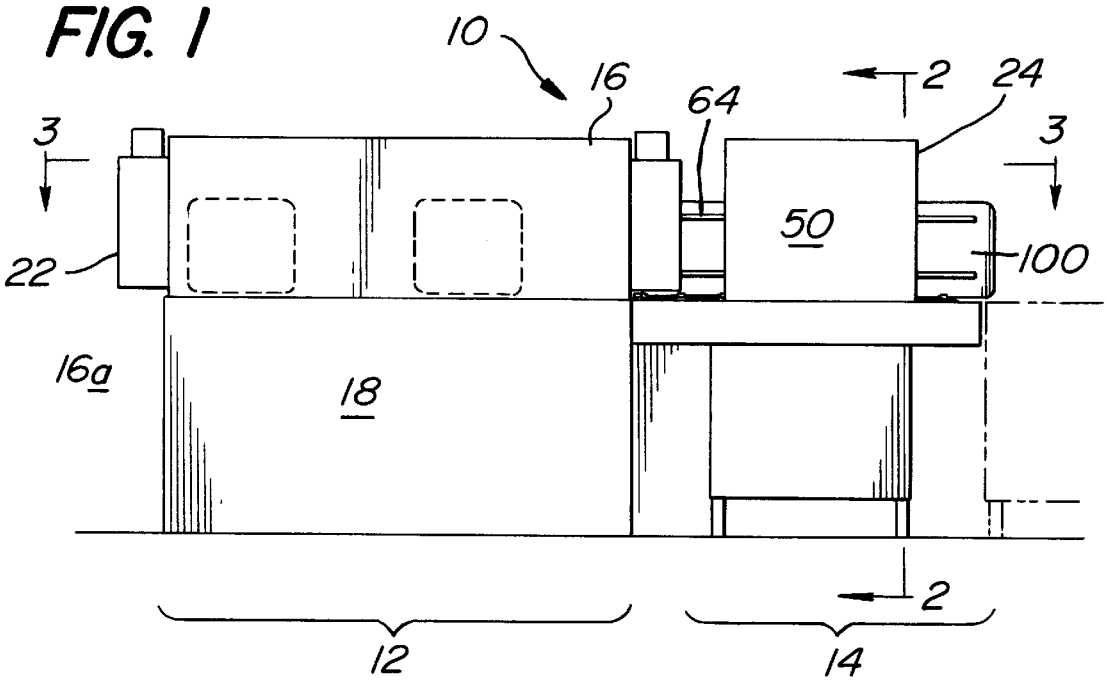
FIG. 1 is a front elevation view of single-unit, combination, conveyor-type washer and dryer embodying the present invention, the path of travel of the trays and dishware being from left to right, as illustrated.
Figure 2:
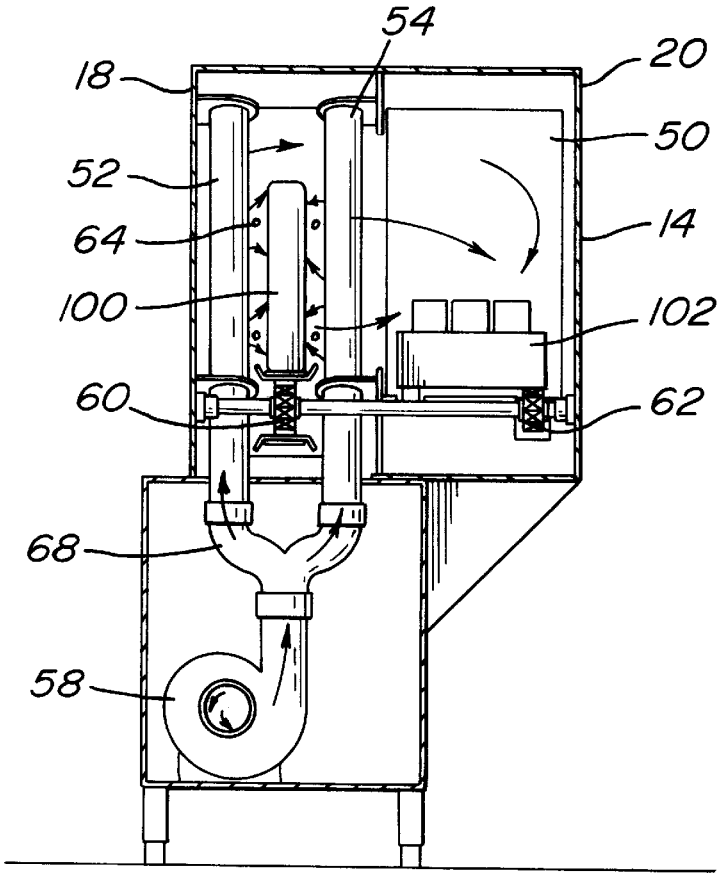
FIG. 2 is a cross-sectional view of the dryer section of the single-unit, combination washer and dryer illustrated in FIG. 1, the view taken along the line 2—2.
Figure 3:
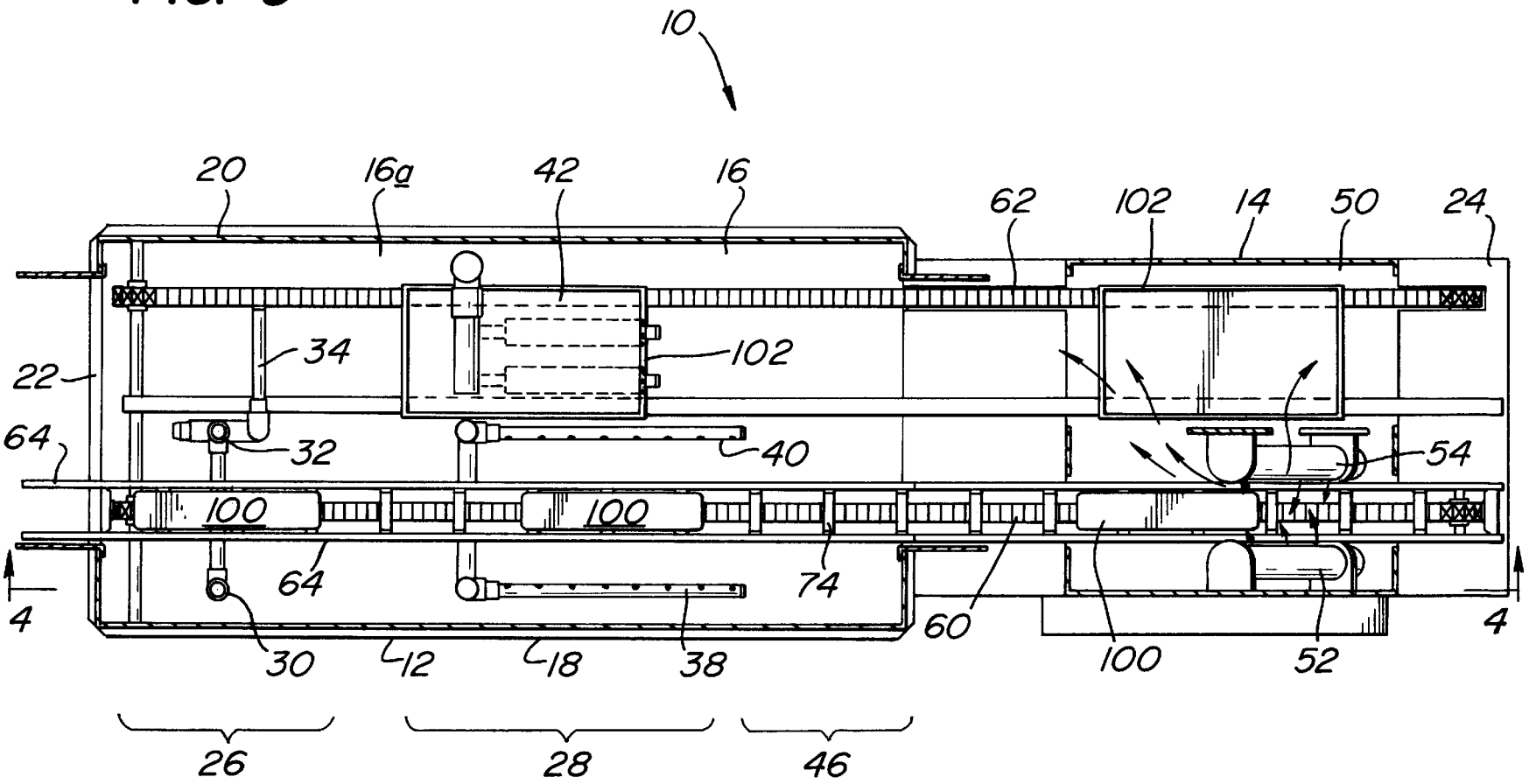
FIG. 3 is a cross-sectional view of the single-unit, combination washer and dryer illustrated in FIG. 1, the view taken along the line 3—3.
Figure 4:
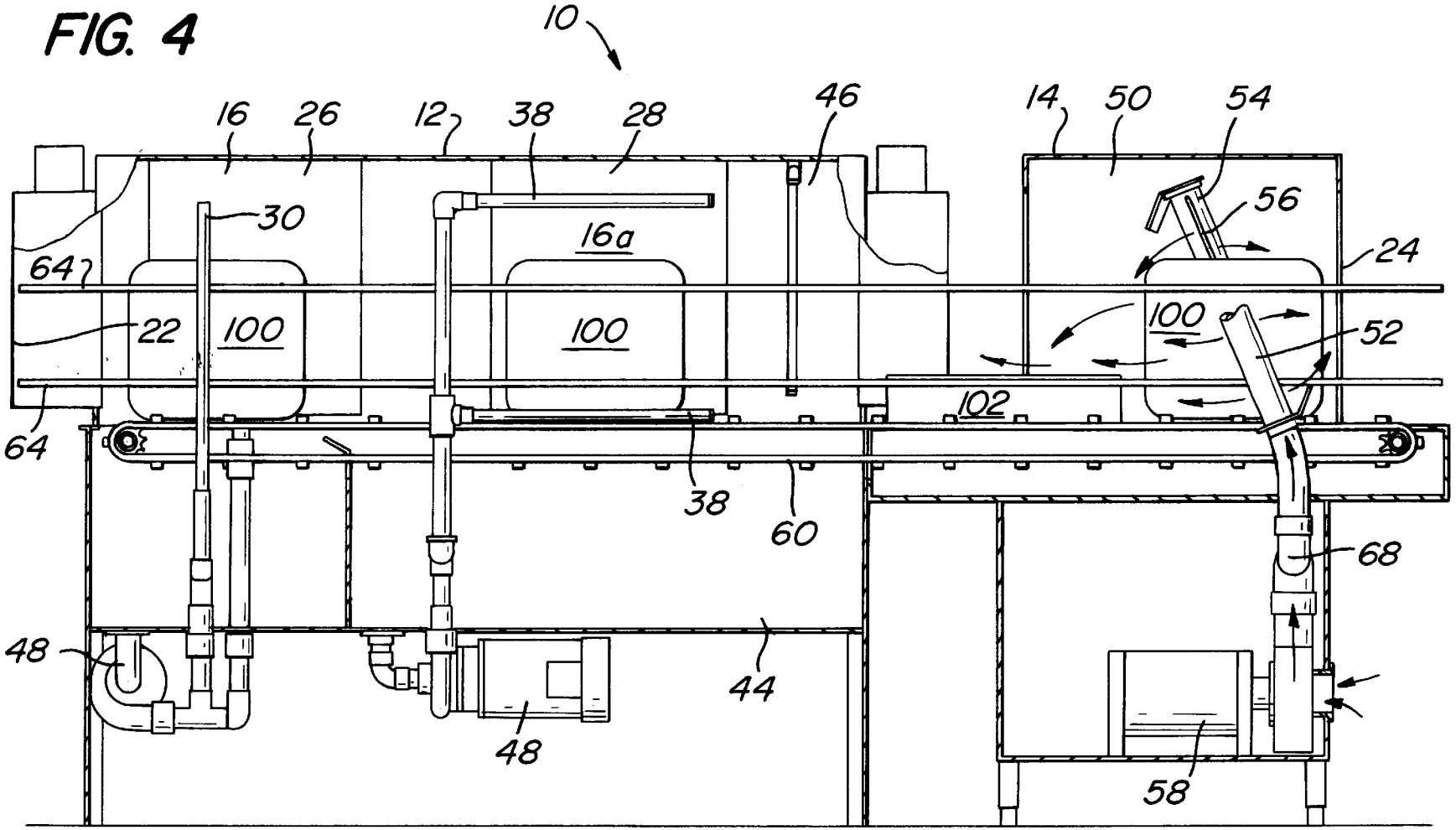
FIG. 4 is a front elevational view of the single-unit washer and dryer of FIG. 1 with the front wall thereof cut away.

As best illustrated in FIGS. 1, 3 and 4, a combination washer and dryer 10 of the present invention is provided as an elongate single unit having two separate, spaced-apart conveyors. One of the conveyors transports trays 100 oriented in a vertically-disposed, upright position through the combination washer and dryer 10, and the other conveyer transports racks 102 capable of containing various dishware and drinking vessels through the combination washer and dryer 10 so that the trays, dishware and vessels can be cleaned simultaneously. The trays 100 can include insulated trays, non-insulated trays, trays with pockets, trays without pockets, plastic trays or any other type of tray.

As illustrated, the path of travel of the trays and racks is from left to right, and the single unit combination washer/dryer 10 includes a washer 12 upstream from a dryer 14. Although all the drawings include the dryer 14, it should be noted that if all of the advantages of the present invention are not required, a single unit, conveyor-type washer 12 can be utilized without a dryer 14. In such an alternate embodiment, the trays, dishware and vessels are allowed to air dry after they exit the washer 12.

The single-unit washer/dryer 10 has a chamber 16 with a wash tank 16*a,* an elongate front side 18, an elongate rear side 20 and opposite ends 22 and 24. An opening in the end 22 of the chamber 16 provides a loading port into which trays and racks can be input into the washer 12. The trays, dishware and vessels are washed in the wash tank 16*a* as they pass through a pre-wash section 26 which is located adjacent the loading port end 22 and a washing section 28 which is located downstream from the pre-wash section 26.

Independent spray systems for the trays 100 and the racks 102 are provided in the wash tank 16*a*. In the pre-wash section 26, a pair of vertically oriented spray arms, 30 and 32, direct a cleaning fluid, such as hot soapy water, toward both upright sides of the trays 100, while a pair of horizontally oriented spray arms 34 which extend perpendicular to the path of the racks 102 direct the cleaning fluid toward the racks 102 from above and below the racks 102. In the washing section 28, two pairs of horizontally oriented spray arms, 38 and 40, which extend parallel to the path of the trays 100 direct the cleaning fluid toward both upright sides of the trays 100, while a number of horizontally oriented spray arms 42 which extend parallel to the path of the racks 102 direct the cleaning fluid toward the racks 102 from above and below the racks 102. Preferably, the spray arms and their associated manifolds are made from stainless steel pipes and are designed to be easily removed, without the use of tools, for cleaning.

The wash tank 16*a* has a tank bottom 44 which extends at least the full length of the pre-wash and washing sections 26 and 28. The cleaning fluid is collected in the tank bottom 44 and pumped through the manifolds and spray arms by pumps 48 located directly below the tank bottom 44. Electric immersion heaters, steam coils, gas coils, or other known heating means (not shown) are located in the tank bottom 44 and are utilized to heat the cleaning fluid to a desired temperature. Preferably, 16 gauge removable stainless steel scrap screens (not shown) are located below the conveyor belts/chains to catch and collect various debris.

After the trays 100 and racks 102 travel through the pre-wash section 26 and washing section 28, they next pass through a rinsing section 46. In the rinsing section 46, heated rinsing fluid is directed toward the trays and racks to remove any remaining debris from the trays, racks and dishware articles, and to sanitize the trays, racks and dishware articles.

In the preferred embodiment of the present invention, which includes a dryer 14, a drying section 50 is located downstream of the rinsing section 46. The drying section 50 provides a novel and energy efficient manner of simultaneously drying both the trays 100 and racks 102. To this end, a pair of nozzles, or air knives, 52 and 54, are located on opposite sides of the path of travel of the trays 100. The air knives 52 and 54 have apertures, or slots, 56 facing toward one another and are connected via conduits 68 to a blower 58 which forces a supply of dry air to impinge directly on the upright sides of the trays 100 thereby removing moisture from the trays. Preferably, as best illustrated in FIG. 4, the air knives, 52 and 54, extend diagonally relative to the trays 100 to sweep moisture in a manner which is controlled, prevents unwanted splashing and prevents uneven drying.

The drying section 50 is configured so that the air discharged against the trays 100 reflects off the sides of the trays 100 and flows turbulently inside the drying section 50 along the path of travel of the racks 102 to promote evaporation of moisture located on the dishware and vessels which are stacked in the racks 102. Thus, the same air supply is used to remove moisture from both the trays 100 and the articles in the racks 102 before being vented from the drying section 50.

Turning now to the dual conveyor system of the present invention, a first conveyor 60 is utilized to transport the trays 100 through the combination washer/dryer 10, and a second conveyor 62 is utilized to transport the racks 102 through the combination washer/dryer 10. Each conveyor, 60 and 62, is preferably provided by an endless chain which is spaced from and extends parallel to the other conveyor. Both chains extend through the pre-wash, washing, rinsing, and drying sections of the single-unit washer/dryer 10, and each is driven by an independent motor (not shown) and includes a frictionless conveyor overload release system (not shown). Guide rails 64 are provided along the path of travel of the tray conveyor 60 to ensure that the trays 100 remain vertically disposed.

By way of example, and not by way of limitation, preferably, the width of the tray conveyor 60 is about 1.5 inches to about 3.5 inches, and the width of the rack conveyor 62 is about 10.25 inches. The preferred rack size is 10 inches by 20 inches. The racks 102 are placed on the conveyor 62 such that the 10 inch sides of the racks are perpendicular to the rack path of travel and the 20 inch sides of the racks are parallel to the rack path of travel. Each conveyor, 60 and 62, is set to a predetermined linear speed. For instance, the tray conveyor 60 can be set to transport up to four hundred, 16 inch by 20 inch, plastic trays 100 through the combination washer/dryer per hour; while the rack conveyer 62 can be set at a speed to convey two hundred and seventeen, 10 inch by 20 inch, racks 102 through the combination washer/dryer per hour. This corresponds to a rack conveyor speed of about 6 feet per minute, while the tray conveyor speed can be between about 8 to about 16 feet per minute.

Figure 5:
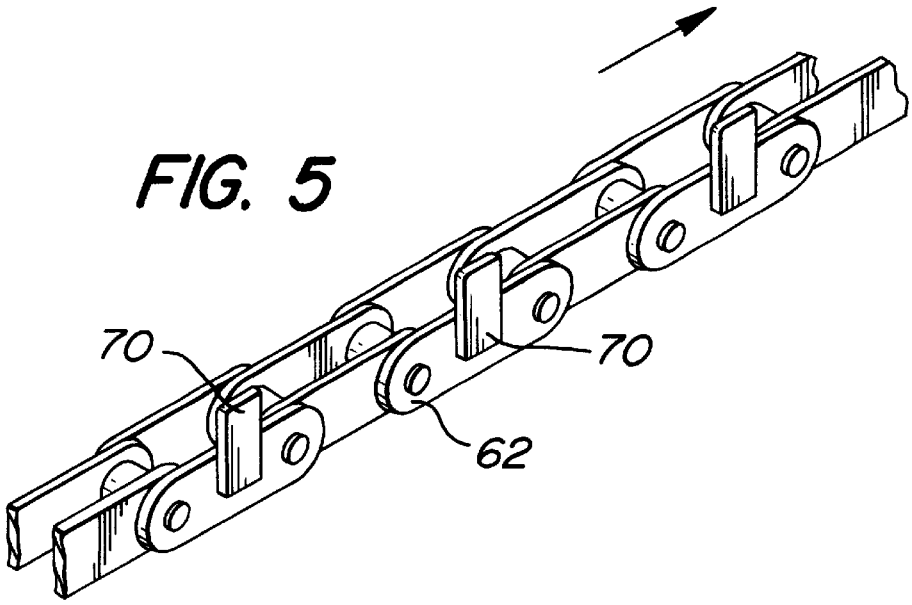
FIG. 5 is a perspective view of a portion of an endless chain which is used to convey racks and which has lugs to prevent fast-racking of racks.
Figure 6:
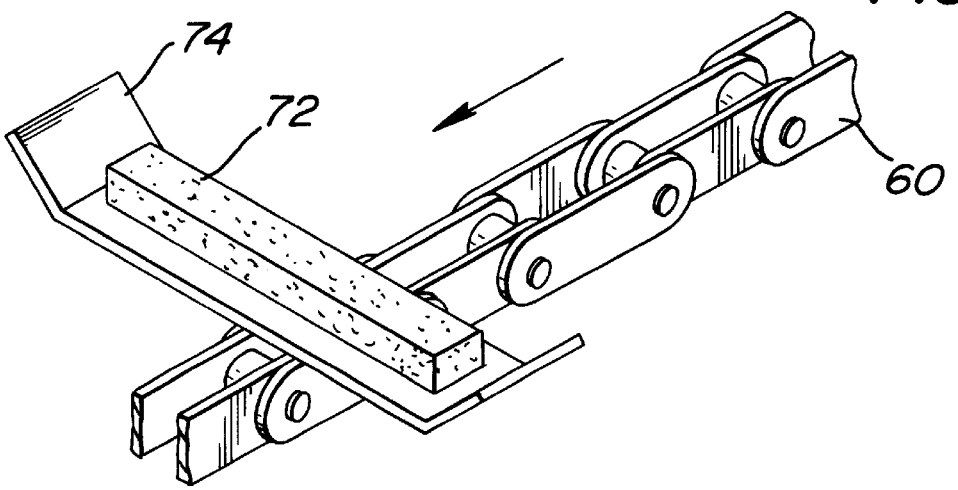
FIG. 6 is a perspective view of a portion of an endless chain which is used to convey trays and which has friction pads to prevent fast-racking of trays.
Figure 7:
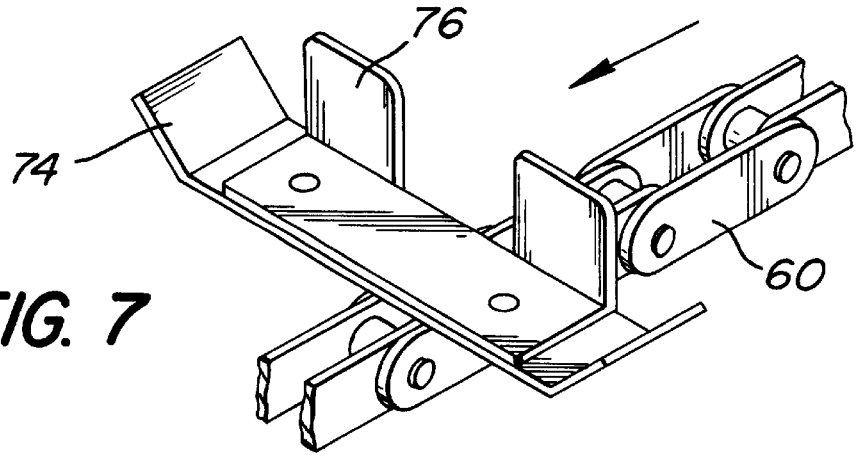
FIG. 7 is a perspective view of a portion of an endless chain which is used to convey trays and which has upstanding lugs to prevent fast-racking of trays.

Another important concept of the present invention is that each conveyor, 60 and 62, is provided with a means to prevent fast-racking of the trays or racks through the washer/dryer 10. The term "fast-racking" refers to the ability of the racks or trays to be manually pushed on the conveyors at a speed greater then the pre-set linear speed of the conveyors. The endless chains of the conveyors 60 and 62 have means 66 which prevent the trays and racks from being manually pushed at a greater speed through the washer/dryer 10 than the intended pre-determined linear speed of the conveyors. As illustrated in FIG. 5, the means 66 for preventing fast-racking of the racks 102 on the conveyor 62 are upstanding lugs 70 which engage the bottom of the racks 102. As illustrated in FIG. 6, one of the means 66 for preventing fast-racking of the trays 100 on the conveyor 60 are urethane friction pads 72 which are located on tray cradles 74 and which frictionally engage the trays 100. As illustrated in FIG. 7, an alternate means 66 for preventing fast-racking of the trays 100 on the conveyor 60 are upstanding lugs 76 which are located on the tray cradles 74 and which engage the leading ends of the trays 100.

A further important concept of the present invention is that the washer/dryer 10 provides ready loading and unloading of trays and racks even when the rear side 20 of the chamber 16 is positioned against a building structure, such as a wall. To this end, the tray conveyor 60 is located adjacent the front side 18 of the chamber 16 and the rack conveyor 62 is located adjacent the rear side 20 of the chamber 16. The tray conveyor 60 is located closer to the front side 18 of the chamber 16 because: (a) the trays are more difficult to load/unload, (b) the tray conveyor 60 runs at a greater linear speed than the rack conveyor 62, and (c) more trays are required to be advanced through the washer/dryer 10 than racks. In addition, the washer/dryer 10 is specifically designed so that both the trays and racks can be loaded/unloaded by a person which is allowed access to the washer/dryer 10 only from adjacent the front side 18 of the chamber 16 and not from the rear side 20.

Many alternative configurations can be utilized for the washer/dryer 10 according to the present invention. For instance, as stated previously, the dryer 14 could be eliminated. Other examples of alterations may include changes to the shape and location of the manifolds and spray arms in the wash tank, changes in the type of conveyor system utilized, and changes in the speeds and relative dimensions of the conveyors.

Thus, the above-described combination, single-unit washer/dryer according to the present invention provides a compact cleaning apparatus for simultaneously cleaning both trays and dishware. The washer/dryer is readily loaded and unloaded in tight spaces, prevents fast racking of trays and racks, and is capable of drying trays and dishware in an efficient manner.

While a preferred single-unit washer/dryer has been described in detail, various modifications, alterations, and changes may be made without departing from the spirit and scope of the washer and washer/dryer according to the present invention as defined in the appended claims.

What is claimed is:

1. A single-unit, conveyor-type washer for simultaneously washing trays and other dishware related articles such as drinking vessels and eating utensils, comprising:

a chamber having an elongate front side, an elongate rear side, and opposite ends, one of said opposite ends defining an entrance and the other of said opposite ends defining an exit, said chamber having at least a washing section and a rinsing section;

a first conveyor extending through said washing and rinsing sections for conveying vertically disposed trays along a path of travel from said chamber entrance to said chamber exit; and a second conveyor extending through said washing and rinsing sections for conveying racks along a path of travel from said chamber entrance to said chamber exit, said second conveyor path of travel being spaced from and substantially parallel to said first conveyor path of travel and said racks being capable of being loaded with various dishware related articles;

said chamber entrance being accessible adjacent said chamber elongate front side for loading said trays and said racks, respectively, onto said first and second conveyors;

said first conveyor being located closer to said chamber elongate front side than to said chamber elongate rear side; and said second conveyor being located closer to said chamber elongate rear side than to said chamber elongate front side.

2. A single unit, conveyor-type washer according to claim 1, wherein said first conveyor conveys the trays along said path of travel of said first conveyor at a pre-determined linear speed, and wherein said first conveyor includes fast-racking-prevention means for preventing the trays from being manually pushed on said first conveyor along said path of travel of said first conveyor at a speed greater than said pre-determined linear speed of said first conveyor.

3. A single unit, conveyor-type washer according to claim 2, wherein said second conveyor conveys the racks along said path of travel of said second conveyor at a pre-determined linear speed, and wherein said second conveyor includes fast-racking-prevention means for preventing the racks from being manually pushed on said second conveyor along said path of travel of said second conveyor at a speed greater than said pre-determined linear speed of said second conveyor.

4. A single unit, conveyor-type washer according to claim 3, wherein each of said first and second conveyors includes an endless chain, and wherein said fast-racking-prevention means of said second conveyer is provided by a plurality of upstanding lugs extending from said endless chain of said second conveyor.

5. A single unit, conveyor-type washer according to claim 4, wherein said fast-racking-prevention means of said first conveyer is provided by a plurality of friction pads carried by said endless chain of said first conveyor.

6. A single unit, conveyor-type washer according to claim 4, wherein said fast-racking-prevention means of said first conveyer is provided by a plurality of upstanding lugs carried by said endless chain of said first conveyor.

7. A single-unit, conveyor-type washer according to claim 4, further comprising a dryer section located adjacent said chamber exit and having at least a pair of nozzles located on opposite sides of said path of travel of said first conveyor, said nozzles being capable of discharging a flow of air in a transverse direction relative to each side face of the vertically disposed trays to remove moisture from the trays.

8. A single-unit, conveyor-type washer according to claim 7, wherein said dryer section is configured to cause said flow of air discharged by said pair of nozzles and reflecting off the trays to flow turbulently within said dryer section along said second conveyor path of travel to promote evaporation of moisture located on the dishware related articles stacked in said racks conveyed by said second conveyor.

9. A single-unit, conveyor-type washer according to claim 8, wherein said at least a pair of nozzles are a pair of spaced apart air knives with apertures facing directly toward each other on opposite sides of said first conveyor path of travel so that the direction of said flow of air is substantially horizontal as said flow of air impinges the opposite side faces of the trays.

10. A single-unit, combination, conveyor-type washer and dryer for washing and drying trays simultaneously with other dishware related articles such as drinking vessels and eating utensils, comprising:

a chamber having an elongate front side, an elongate rear side, and opposite ends, one of said opposite ends defining an entrance and the other of said opposite ends defining an exit, said chamber having at least a washing section, a rinsing section and a drying section, said drying section being located adjacent said chamber exit;

a first conveyor extending through said washing, rinsing and drying sections for conveying vertically disposed trays along a path of travel from said chamber entrance to said chamber exit;

a second conveyor extending through said washing, rinsing and drying sections for conveying racks along a path of travel from said chamber entrance to said chamber exit, said second conveyor path of travel being spaced from and substantially parallel to said first conveyor path of travel and said racks being capable of being loaded with various dishware related articles; and at least a pair of nozzles located in said drying section on opposite sides of said first conveyor path of travel for discharging a flow of air at a transverse direction onto each side face of the vertically disposed trays to remove moisture on the trays;

said dryer section being configured to cause said flow of air discharged by said pair of nozzles and reflecting off the trays to flow turbulently within said dryer section along said second conveyor path of travel to promote evaporation of moisture located on the dishware related articles stacked in said racks conveyed by said second conveyor.

11. A single unit, combination, conveyor-type washer and dryer according to claim 10, wherein said first conveyor conveys the trays along said path of travel of said first conveyor at a pre-determined linear speed, and wherein said first conveyor includes fast-racking-prevention means for preventing the trays from being manually pushed on said first conveyor along said path of travel of said first conveyor at a speed greater than said pre-determined linear speed of said first conveyor.

12. A single unit, combination, conveyor-type washer and dryer according to claim 11, wherein said second conveyor conveys the racks along said path of travel of said second conveyor at a pre-determined linear speed, and wherein said second conveyor includes fast-racking-prevention means for preventing the racks from being manually pushed on said second conveyor along said path of travel of said second conveyor at a speed greater than said predetermined linear speed of said second conveyor.

13. A single-unit, combination, conveyor-type washer and dryer according to claim 12, wherein said at least a pair of nozzles are a pair of spaced apart air knives with apertures facing directly toward each other on opposite sides of said first conveyor path of travel so that the direction of said flow of air is substantially horizontal as said flow of air impinges the opposite side faces of the trays.

14. A single-unit, combination, conveyor-type washer and dryer according to claim 13, wherein said chamber entrance is accessible adjacent said chamber elongate front side for loading said trays and said racks, respectively, onto said first and second conveyors, wherein said first conveyor is located closer to said chamber elongate front side than to said chamber elongate rear side; and wherein said second conveyor is located closer to said chamber elongate rear side than to said chamber elongate front side.

15. A single-unit, combination, conveyor-type washer and dryer for washing and drying trays simultaneously with other dishware related articles such as drinking vessels and eating utensils, comprising:

a chamber having an elongate front side, an elongate rear side, and opposite ends, one of said opposite ends defining an entrance and the other of said opposite ends defining an exit, said chamber having a pre-wash section, a washing section, a rinsing section and a drying section, said drying section being located adjacent said chamber exit;

a first conveyor extending through said pre-washing, washing, rinsing and drying sections for conveying vertically disposed trays at a pre-determined linear speed along a path of travel from said chamber entrance to said chamber exit, said first conveyor being located closer to said chamber elongate front side than to said chamber elongate rear side;

a second conveyor extending through said pre-washing, washing, rinsing and drying sections for conveying racks along a path of travel at a pre-determined linear speed from said chamber entrance to said chamber exit, said second conveyor path of travel being spaced from and substantially parallel to said first conveyor path of travel, said racks being capable of being loaded with various dishware related articles, and said second conveyor being located closer to said chamber elongate rear side than to said chamber elongate front side; and a pair of spaced apart air knives located in said drying section on opposite sides of said first conveyor path of travel, said air knives having apertures facing toward each other on opposite sides of said first conveyor path of travel to discharge a flow of air onto each side face of the vertically disposed trays to remove moisture from the trays;

said dryer section being configured to cause said flow of air discharged by said pair of air knives to reflect off the trays and to flow turbulently within said dryer section along said second conveyor path of travel to promote evaporation of moisture located on the dishware related articles stacked in said racks conveyed by said second conveyor;

said first conveyor including an endless chain with fast-racking-prevention friction pads for preventing the trays from being manually pushed on said first conveyor along said path of travel of said first conveyor at a speed greater than said pre-determined linear speed of said first conveyor;

said second conveyor including an endless chain with fast-racking-prevention lugs for preventing the racks from being manually pushed on said second conveyor along said path of travel of said second conveyor at a speed greater than said pre-determined linear speed of said second conveyor, and said chamber entrance being accessible adjacent said chamber elongate front side for loading said trays and said racks, respectively, onto said first and second conveyors.

16. A single-unit, combination, conveyor-type washer and dryer according to claim 15, wherein each of said first and second conveyors is driven independently so that said first and second conveyors are capable of operating at different pre-determined linear speeds.

17. A single-unit, combination, conveyor-type washer and dryer according to claim 15, wherein said first conveyor has associated guide rails which retain the trays in a vertically disposed position.

18. A single-unit, combination, conveyor-type washer and dryer according to claim 15, wherein said pre-wash section is located adjacent said entrance.

19. A single-unit, combination, conveyor-type washer and dryer according to claim 15, wherein said racks have a rectangular periphery which is substantially 10 inches by 20 inches.

20. A single-unit, combination, conveyor-type washer and dryer according to claim 19, wherein said second conveyor conveys said rack such that said 20 inch sides of said rack are oriented in a parallel relation to said path of travel of said first conveyor and said 10 inch sides of said rack are oriented in a perpendicular relation to said path of travel of said first conveyor.

* * * * *